United States Patent [19]

Collura et al.

[11] Patent Number: 4,609,143

[45] Date of Patent: Sep. 2, 1986

[54] COMBINED LOCK STRUCTURE FOR ARTICLE CARRIER

[75] Inventors: Peter C. Collura; Richard L. Humphries; John K. Lever, all of Redwood City, Calif.

[73] Assignee: Certipak Corporation, Greenwich, Conn.

[21] Appl. No.: 664,474

[22] Filed: Oct. 24, 1984

Related U.S. Application Data

[63] Continuation of Ser. No. 488,673, Apr. 26, 1983, abandoned.

[51] Int. Cl.[4] ..... B65D 5/04; B65D 75/06

[52] U.S. Cl. ..... 229/40; 206/140

[58] Field of Search ..... 229/40, 45; 24/204; 206/140, 434

[56] References Cited

U.S. PATENT DOCUMENTS

| | | | |
|---|---|---|---|
| 1,655,460 | 1/1928 | Galbraith et al. | 229/40 |
| 2,798,603 | 7/1957 | Grinspoon | 206/140 X |
| 2,990,997 | 7/1961 | Weiss | 229/40 |
| 3,373,867 | 3/1968 | Wood | 206/140 |
| 3,380,645 | 4/1968 | Pierce, Jr. | 229/40 |
| 3,410,397 | 11/1968 | Cato | 206/140 |
| 3,554,431 | 1/1971 | Lock | 206/140 X |
| 3,570,746 | 3/1971 | Wood | 229/40 |
| 3,670,879 | 6/1972 | Williard et al. | 229/40 X |
| 4,215,781 | 8/1980 | Humphries et al. | 206/434 |

*Primary Examiner*—William Price
*Assistant Examiner*—Bryon Gehman
*Attorney, Agent, or Firm*—King and Schickli

[57] ABSTRACT

A thread and punch lock for article carriers includes a first closure panel with a plurality of spaced tongues along its terminal end. A locking tab is provided in longitudinal line with each tongue and adjacent thereto. The tab extends in opposing direction to the tongue; the tab and tongue together forming a locking unit. The second closure panel includes two substantially parallel, transversely elongated slits for receiving each locking unit when the closure panels are in proper overlapping relation. Disposed between these slits is the closure panel material forming a protector strap. The closure panels are locked together by inserting the tongue through the slit furthest from the edge of the second closure panel. The tab is then punched in the slit nearest the edge of the second closure panel so as to overlie the second closure panel and create edge to edge engagement. The protector strap overlies the tab along the interior of the carrier to hold the tab in locked engagement and provide extra strength.

12 Claims, 6 Drawing Figures

COMBINED LOCK STRUCTURE FOR ARTICLE CARRIER

This is a continuation of application Ser. No. 488,673, filed Apr. 26, 1983, now abandoned.

TECHNICAL FIELD

This invention relates to an article carrier of the wraparound type and, more particularly, to a carrier for packaging a plurality of articles in a row having an improved thread-and-punch type lock for interlocking overlapping panels of the carrier.

BACKGROUND ART

U.S. Pat. No. 3,374,938 to Pierce, Jr., assigned to the present assignee, is directed to an article carrier of the wraparound type in which the bottom panels are secured in overlapping relation. A plurality of tongues on one of the bottom panels is threaded into corresponding transversely elongated apertures in the other of the bottom panels. Each of the tongues has a locking tab longitudinally aligned therewith for disposition in the same transversely elongated aperture as the tongue. When the carrier is erected and filled, the tab is punched through the aperture by the packaging machine to lock the panels together. Each of the tongues is threaded in the position to have an edge to edge engagement with a transverse locating edge of the corresponding aperture. Each locking tab, after being punched into position, also has an edge to edge engagement with the opposite transverse edge of the aperture to lock the overlapping bottom panels of the elongated blank to form the carrier.

During the retail life of these carriers, many are subject to rough handling and other conditions having a tendency to loosen or release the locks. Also, the carriers are routinely exposed to refrigerated conditions. Under such conditions the paper with which the carrier is formed may absorb moisture and consequently lose stiffness. This causes the locks to be more susceptible to inadvertent lock release. Because of this, improved locking strength and lock protection is a vital concern continually sought by those skilled in the packaging art. As will be seen below, the carrier of the present invention is an improvement over the prior art Pierce carrier in that it does establish and retain better edge to edge relation along two substantially parallel, transversely elongated slits, and provides lock protection by providing a protector strap which overlies the tab along the interior of the carrier.

U.S. Pat. No. 4,200,220 to Ganz is also part of the prior art. This patent is also directed to an article carrier of the wraparound type in which the bottom panels are secured in overlapping relation. The tongues on one of the bottom panels are threaded into corresponding transversely elongated slits in the other of the bottom panels, but this is done only after doubling over each bottom panel wth a fold of 180°. Each of the tongues has a tab longitudinally aligned therewith for disposition in a cooperating elongated slit on the opposite bottom panel. However, when locked in place, there is no edge to edge engagement for the best locking performance. Instead, the tab lies in a plane substantially perpendicular to the plane in which the tongue lies.

This carton requires complicated machinery to perform the doubling over folds and threading of the tongue and tab. Also, the tab which extends vertically into the interior of the carton is susceptible to damage by the articles within the carrier and in a damaged state, likely to slip back through the receiving slit. The doubling feature greatly increases the cost of the carrier due to the increase in paperboard required.

Thus, the need for an improved article carrier lock that is more secure and reliable is identified. In this regard, it is contemplated that the lock should have a tab and tongue extending in opposite directions within substantially the same plane, thereby providing a secure edge to edge engagement, and including a protective arrangement for improved lock retention and for additional strength and support.

DISCLOSURE OF THE INVENTION

Accordingly, it is a primary object of the present invention to provide a wraparound carrier which overcomes the limitations and disadvantages of the prior art as described.

More specifically, it is an object of the present invention to provide a wraparound carrier with improved locking retention and additional strength and durability.

Another object of this invention is to provide a wraparound carrier which minimizes paperboard requirement and thus costs less to manufacture.

Another object of this invention is to provide a lock structure in a wraparound carrier including spaced locking slits to receive and retain a locking unit with protection against inadvertent release.

Still another object of this invention is to provide a lock in a carrier having specially formed slits for the purpose indicated to provide improved lock performance and additional security.

Still another object of this invention is to provide a wraparound carrier with an improved lock as described that is easy to erect on existing high-speed equipment.

Additional objects, advantages, and other novel features of the invention will be set forth in part in the description that follows and in part will become apparent to those skilled in the art upon examination of the following or may be learned with practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved wraparound carrier is provided for the packaging of a plurality of articles in at least a single row. The carrier includes an elongated blank having fold lines to form panels including closure panels designed to overlap when applied to the articles to be packaged. One of the closure panels has a plurality of locking units spaced from each other transversely of the blank, each including a tongue and a locking tab in longitudinal line with each tongue and adjacent thereto. The other of the closure panels includes a plurality of two substantially parallel, transversely elongated slits for receiving each locking unit when the closure panels are in proper overlapping relation. Disposed between these slits is closure panel material forming a protector strap. When properly locked, each tongue is inserted through the corresponding slit furthest from the edge of the second closure panel. The locking tab is then punched in the slit nearest the edge of this closure panel so as to overlie this closure panel and create edge to edge engagement. The protector strap overlies the tab along the interior of the carrier to hold the tab in locked engagement and to provide extra strength.

The tongue and locking tab extending in opposing directions and engaging the locating edge and the locking edge of the two slits, respectively, are within the same plane and thus provide the carrier with secure edge to edge engagement between the closure panels. Since the tab does not extend vertically up into the carrier, but instead is positively held down by the protector strap, it is protected from being inadvertently damaged and dislodged by the articles therein. Also, the positive edge to edge engagement prevents either the threaded tongue or the punched in tab from slipping through its slit. Improved lock retention that in turn improves carton reliability is the favorable result obtained.

Since the invention employs two, substantially parallel, transversely elongated slits, and a protector strap in between, the need to strip the trim from a hole or aperture, as often required in the prior art is avoided. This feature, coupled with reduced paperboard required with respect to some designs, substantially reduces the cost incurred by the manufacturer.

Advantageously, the present invention provides convenient mechanical threading and punching for easy adaptation to high speed, state of the art automation techniques and machines.

Still further, the protector strap which overlies the tab along the interior of the carrier to hold the tab in locked engagement also increases the strength of the panel in the lock area. Whereas before a relatively wide aperture (absence of material) existed, the protector strap connected by bridges at each end span the lock area. This strap provides an article carrier of increased strength over those in the prior art even after exposure to refrigerated conditions wherein the paper absorbs moisture and loses stiffness.

Still other objects of the present invention will become readily apparent to those skilled in the art in the following description wherein there is shown and described a preferred embodiment of this invention, simply by way of illustration of one of the modes best suited to carry out the invention. As it will be realized, the invention is capable of other different embodiments, and its several details are capable of modification of various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 2:
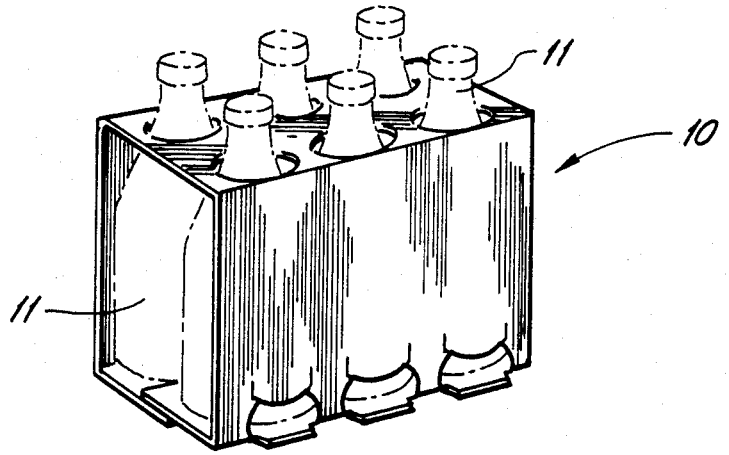
FIG. 2 is a perspective view of the article carrier of the present invention having a plurality of articles such as bottles, supported therein after completion of forming the blank into the carrier.

Referring to the drawings and particularly to FIG. 2, there is shown an article carrier 10 of the wraparound type for a plurality of articles such as bottles 11, for example, arranged in one or more rows. As shown in FIG. 2, the bottles 11 are arranged in two rows, but there can be only a single row or more than two rows.

The article carrier 10 is formed from an elongated blank 12 (see FIG. 1) of a suitable foldable sheet material such as paperboard, for example. The elongated blank 12 has a single top panel 14 with circular apertures 13 cut therein to accommodate the necks of the bottles 11.

Side panels 16 are articulated or hingedly joined to opposite sides of the top panel 14 along a pair of top fold lines 15. The side panels 16 are designed to be substantially vertical in the completed article carrier 10, as shown in FIG. 2.

A bottom or closure panel 21 is articulated or hingedly joined to one of the side panels 16 along a fold line 22 (see top of FIG. 2). Another bottom or closure panel 23 is articulated or hingedly joined to the other of the side panels 16 by fold line 24.

The bottom panel 21 has a plurality of transversely spaced lock units each including a tongue 25 (three shown in FIG. 1) with the number of tongues 25 preferably being equal to the number of bottles 11 (see FIG. 2) in each of the rows. The tongues 25 (see FIG. 1) are spaced from each other by recessed edge portions 26 between the tongues.

The outer ends of the edge along the panel 21 adjacent the end tonuges 25 are formed by an edge extension 30 and connect to longitudinal side edges 31 and 32 of the elongated blank 12. The bottom panel 21 thus has its terminal edge defined by the edges of the tongues 25, the recessed edge portions 26 and the connecting edge extensions 30.

The bottom panel 23 has a plurality of pairs of adjacent, substantially parallel, transversely elongated slits for receiving the corresponding locking units when the closure panels are in proper overlapping relation. First transversely elongated slits 33 are formed adjacent the terminal edge 34 of the bottom panel 23, between the terminal edge 34 and second transversely elongated slits 35. As should be appreciated, each slit 33 or 35 forms a pair of paperboard edges substantially in abutting relationship.

The locking units engage and deflect the abutting edges of the slits 33, 35 to form the locking engagement. The bottom panel material disposed between the first slits 33 and second slits 35 forms a full width protector strap 38 that extends substantially entirely within a single plane (note FIGS. 1, 3 and 4). The first slit 33 may include relief extensions **33*a* at each end thereof. These extensions 33*a* preferably are at an angle of about 135° from the slit 33. Second transversely elongated slits 35 may include relief slits 35*a* at each end thereof. These relief slits 35***a* extend toward the first transversely elongated slits 33 at an angle of approximately 90° from the second transversely elongated slits 35. The corner is rounded to minimize the tendency to tear the paperboard.

The relief extensions 33*a* and relief slits 35*a* further define the bridges 36 at the ends of the protector strap 38. The bridges 36 (see FIGS. 1 and 4) have a length substantially equal to the combined length of relief extensions 33*a* and slits 35*a* to insure maximum strength while at the same time providing the required relief for ease of engaging the lock units.

Figures 4A, 4B, 4C:
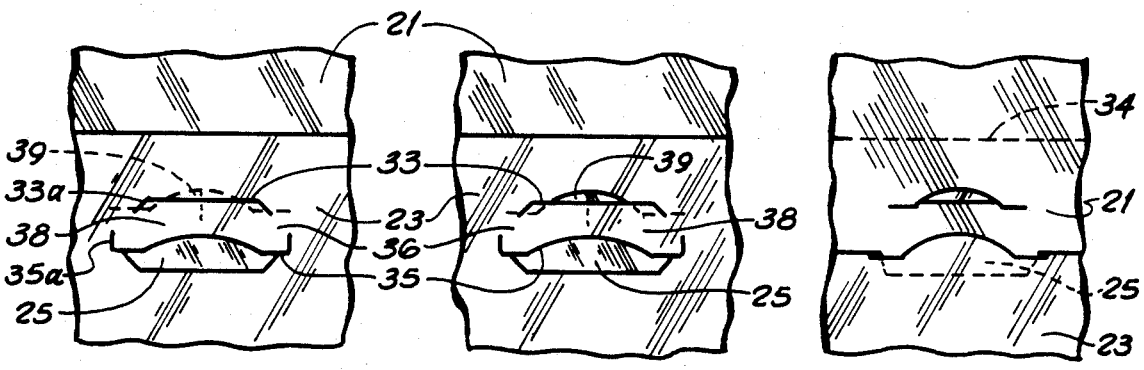
FIG. 4A is an enlarged fragmentary plan view showing in more detail the threading of the tongue through the transversely elongated slit furthest from the edge of the opposite closure panel.
FIG. 4B is a similar fragmentary plan view showing the relationship of the closure panels following the punching of the locking tab in the slit nearest the edge of the opposite closure panel.
FIG. 4C is an underside fragmentary plan view showing the relationship of the locking tab and the tongue within the transversely elongated slits of the blank.

Each of the tongues 25 is threadable into one of the transversely elongated slits 35 when the bottom or closure panels 21 and 23 are in overlapping relation. Each tongue 25 overlies the inner transverse edge of the corresponding slit 35 so as to have a relatively large area of overlapping contact (FIG. 4A). As can be seen, the edge of the slit 35 forms a locating edge for the locking unit with the edges of the slit deflecting to form an opening substantially the thickness of the sheet material.

Figure 1:
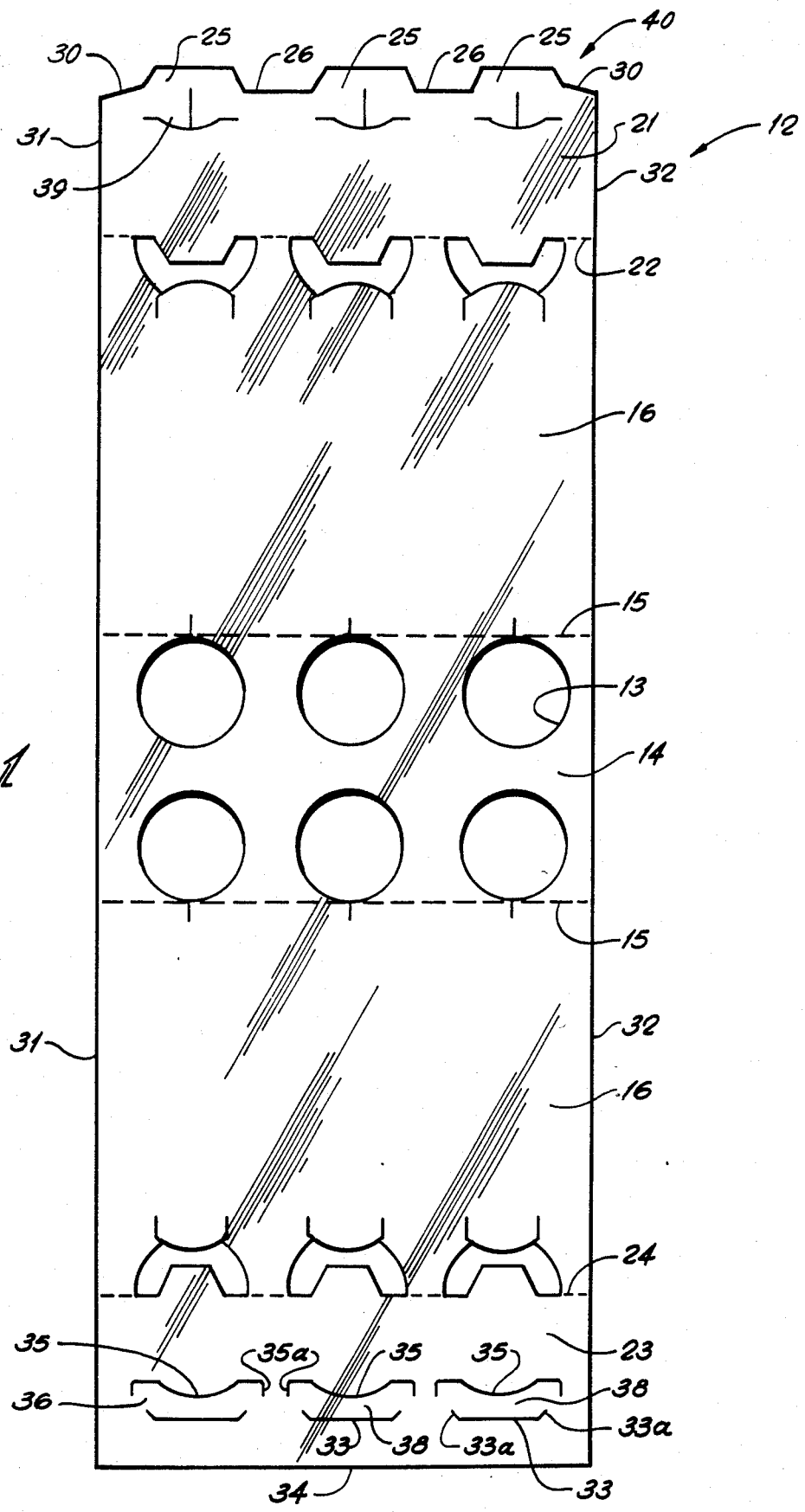
FIG. 1 is a top plan view of an elongated blank from which an article carrier of the present invention is formed.

The bottom panel 21 has a set of locking tabs, designated by the reference numeral 39; a single locking tab being longitudinally aligned with each of the tongues 25. The locking tabs 39 are formed through slitting the bottom panel 21 and may be bifurcated, as shown in the preferred embodiment. The locking tabs 39 and the tongues 25 together form the locking unit, generally designated by the reference numeral 40 (FIGS. 1 and 3).

Figure 3:
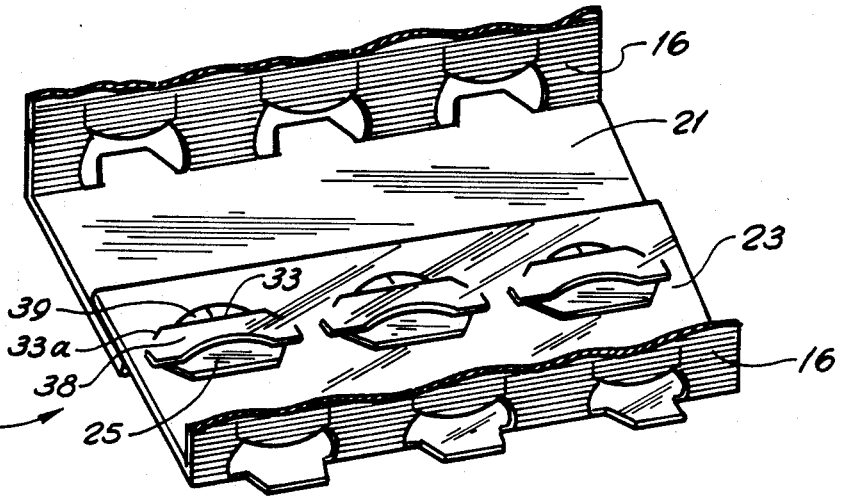
FIG. 3 is a fragmentary inside perspective view of the carrier showing the relation of the bottom panels of the blank when in proper overlapping and locked relation.

When the elongated blank 12 is folded to form the carrier 10 with the bottles 11 therein, the bottom panels 21 and 23 are in overlapping relation (see FIGS. 2 and 3). When each tongue 25 is first threaded within the corresponding transversely elongated slit 35, the locking tab 39 underlies the closure panel 23 (see FIG. 4A looking from inside).

The locking tab 39 is then punched (from below) through the transversely elongated slit 33 so that the locking tab 39 directly overlies closure panel 23 thereby providing edge to edge engagement with the transverse edge (see FIG. 4B). Further, the protector strap 38 overlies the tab 39 to hold the tab in locked engagement while providing additional strength and support to the carrier 10. A fragmentary view of the fully threaded article carrier 10 from below is shown in FIG. 4C.

In forming the carrier 10 from the elongated blank 12, the elongated blank 12 is first placed over the necks of the bottles 11. When the elongated blank 12 is properly seated horizontally on the bottles 11, the side panels 16 are folded down the sides. Then, the bottom panels 21 and 23 are folded under the bottoms of the bottles 11. The tongues 25 are threaded into the transversely elongated slits 35 and the locking tabs 39 are punched into the longitudinally aligned transversely elongated slits 33 by forcing with punching wheels (not shown) past the transverse edge of the slits 33 the deflected edges of the slit 33 forming an opening substantially the thickness of the paperboard material for secure locking action.

The locking arrangement of the present invention enables a relatively large edge to edge locating and locking engagement in a transverse direction. A firm, secure and protected locking engagement safe against inadvertent release is provided. The improved performance is obtained without any increase in paperboard in the blank over that used in the original Pierce carrier shown in the previous Certipak patent cited above, and considerably less than that used in later patents seeking to improve the strength.

The use of slits rather than apertures, as in the prior art, negates the need to strip the trim from the closure panel that receives the locking unit. This not only reduces the manufacturing costs incurred by carton manufacturers, but provides a protective strap 38 overlying the locking tab along the interior of the carrier to hold the tab in locked engagement and provide extra strength. This is a particularly important consideration under refrigerated conditions when the paper absorbs moisture and loses stiffness.

The lock structure of the present invention also provides convenient mechanical threading and punching for adaptation with state of the art machines and improved automation techniques.

The foregoing description of the preferred embodiment of the invention has been presented for purposes of illustration and description. It is not intended to be exhaustive or to limit the invention to the precise form disclosed. Obvious modifications and variations are possible in light of the above teachings. For example, the blank could be provided with slits having different shapes and configurations. The edges of the blank may not necessarily be as shown but could include other shapes and separate angled portions. The embodiment was chosen and described to provide the best illustration of the principles of the invention and its practical application to thereby enable one of ordinary skill in the art to utilize the invention in various embodiments and with various modifications as are suited to the particular use contemplated. Also such modifications and variations are within the scope of the invention as determined by the appended claims when interpreted in accordance with the breadth to which they are fairly, legally and equitably entitled.

We claim:

1. An article carrier of the wraparound type of sheet material for packaging a plurality of articles in at least one row including an elongated blank having fold lines to form panels comprising:

a pair of closure panels designed to overlap when applied to the articles to be packaged, a first closure panel of said pair of closure panels including a plurality of locking units, each locking unit having a tongue along a terminal edge of said first panel and a locking tab in longitudinal alignment therewith, a second closure panel of said pair of closure panels including a plurality of first and second transversely elongated slits, each slit being formed by opposite, cooperating edges of sheet material substantially in abutting relationship, said first slits being adjacent and substantially parallel to said second slits and lying between said second slits and a terminal edge of said second closure panel, said terminal edge of said second closure panel being opposite of said terminal edge of said first closure panel on said blank, said first and second slits having closure panel material therebetween, said material forming a full width protector strap extending substantially entirely within a single plane between the substantially abutting edges of said first and second slits, one protector strap being in longitudinal alignment with each locking unit; each of said second slits having one of said tongues threadable between the deflected edges thereof forming a first opening substantially the thickness of said sheet material so that said tongue overlies said second closure panel when said closure panels are in overlapping relation, each of said first slits having one of said locking tabs punchable between the deflected edges thereof forming a second opening substantially the thickness of said sheet material so that said locking tab overlies said second closure panel and includes edge-to-edge engagement with said second closure panel, said protector strap overlying said locking tab along the interior of said carrier to retain said locking tab in locked engagement and provide extra strength.

2. The article carrier disclosed in claim 1, wherein each of said first slits includes a pair of relief extensions, one extension at each end of said first slit, said extensions extending toward said adjacent second slit.

3. The article carrier disclosed in claim 2, wherein said extensions are at an angle of substantially 135° from said first slit.

4. The article carrier as disclosed in claim 1, wherein each of said second slits includes a pair of relief slits, one relief slit at each end of said second slit, said relief slits extending toward said adjacent first slit.

5. The article carrier disclosed in claim 4, wherein said relief slits are at an angle of substantially 90° from said second slit.

6. The article carrier disclosed in claim 1, wherein each of said first slits includes a pair of relief extensions, one at each end of said first slit, said extensions extending toward said adjacent second slit at an angle of substantially 135° from said first slit; and each of said second slits includes a pair of relief slits, one relief slit at each end of said second slit, said relief slits extending toward said adjacent first slit at an angle of substantially 90° from said second slit; said relief slits and said relief extensions terminating with a bridge of closure panel material therebetween, said relief slits and relief extensions further outlining said protector straps.

7. The article carrier disclosed in claim 6, wherein the pair of relief slits for said second slits are rounded to minimize strain at the 90° corner.

8. The article carrier disclosed in claim 6, wherein said bridge at each end of said slits is substantially equal in length to the combination length of the adjacent relief extension and relief slit to insure sufficient strength and lock retention.

9. The article carrier disclosed in claim 8, wherein said bridge at each end of said slits extends along the line of the relief extension at substantially 135° toward the end of the relief slit.

10. The article carrier disclosed in claim 1, wherein said locking tab is bifurcated along the free edge to provided added flexibility during the punching operation.

11. The article carrier disclosed in claim 1, wherein said tongue and said locking tab extend through the respective slits so as to lie in substantially the same plane and parallel to said closure panels and said protector strap.

12. The article carrier disclosed in claim 1, wherein said tongue extends through said first slit so as to include edge to edge engagement.

* * * * *